United States Patent [19]

Gallimard

[11] Patent Number: 4,472,334

[45] Date of Patent: Sep. 18, 1984

[54] METHOD OF INTRODUCING A MAGNETIC CORE INTO A COIL

[75] Inventor: Jacques Gallimard, Gentilly, France

[73] Assignee: U.S. Philips Corporation, New York, N.Y.

[21] Appl. No.: 146,839

[22] Filed: May 5, 1980

[30] Foreign Application Priority Data

May 23, 1979 [FR] France ..... 79 13134

[51] Int. Cl.[3] ..... B28B 1/08

[52] U.S. Cl. ..... 264/69; 29/606; 264/71; 264/111; 264/134; 264/DIG. 58; 419/9

[58] Field of Search ..... 264/26, 69, 61, 71, 264/104, 111, 112, 128, 134, 267, DIG. 58, DIG. 46; 29/606; 260/29.1 R

[56] References Cited

U.S. PATENT DOCUMENTS 3,021,573 2/1962 Bentov ..... 264/112

4,108,815 8/1978 Audykowski ..... 260/29.1 R

*Primary Examiner*—Jay H. Woo

*Assistant Examiner*—Willie Thompson

*Attorney, Agent, or Firm*—Robert T. Mayer; Bernard Franzblau

[57] ABSTRACT

A method of making a magnetic core for a coil so that the coil obtains a desired final inductance value. The core is introduced into the coil by partly filling the inner volume of a coil former with a soft magnetic powdery material which is subsequently maintained in the correct position by the deposition of a tough liquid material on the powdery material surface, said tough liquid material forming a cover plate after curing.

6 Claims, 4 Drawing Figures

METHOD OF INTRODUCING A MAGNETIC CORE INTO A COIL

The invention relates to a method of introducing a magnetic core into a coil which is wound on a cylindrical coil former which is rigidly connected to a base comprising contact pins.

The invention particularly relates to tuning coils of intermediate frequency amplifier circuits for television receivers. The coils of the intermediate frequency amplifiers are formed by a coil former which is made of a synthetic material and on which the wire is wound, tuning being effected by means of a threaded ferromagnetic core which is displaceable in the former. To this end, the former comprises, for example, threaded portions or ridges.

Due to manufacturing tolerances, the core may in some cases have too much play in the former, which adversely affects the precision of the tuning, and in other cases it may be clamped too much, thus impeding the tuning.

Moreover, tuning by the turning of the cores is difficult and time consuming.

The invention has for an object to achieve a substantial simplification in the introduction of the core and the tuning of the coil.

To this end, the method in accordance with the invention is characterized in that during a first phase a given quantity of a powdery soft-magnetic material is introduced into the coil former, a given quantity of a tough, liquid material which forms a cover plate after spreading and curing being deposited on the surface of the powdery material during a second phase.

The invention utilizes the fact that soft ferrite powders having substantially spherical grains with a diameter of approximately 40 microns can be industrially manufactured.

Preferably, the coil is subjected to a vibratory motion during the introduction of the powdery material.

Thanks to the fact that the powdery material used is formed by spherical, suitably calibrated grains of small dimensions, this material can easily pass through a small opening, so that the quantity of material thus introduced can be very accurately checked. Moreover, the vibratory motion slightly increases the density of the powdery material, so that the volume of the core thus formed will not decrease at a later stage.

The execution of the method in two simple phases, i.e. the filling and the covering, enables full automation of the manufacture of individual coils and of a group of coils accomodated on a printing wiring board.

The invention will be described in detail hereinafter with reference to the accompanying diagrammatic drawing in which.

Figure 1:
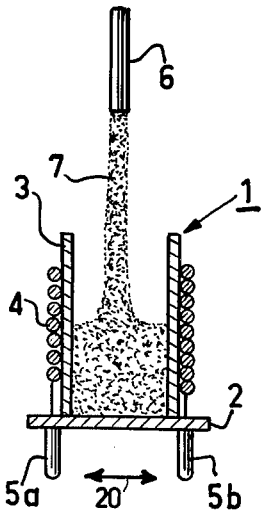
FIG. 1 is a longitudinal sectional view of a coil during the filling phase.

The coil shown in FIG. 1 is formed by a base 2 provided with a former 3 which supports a winding 4, the ends of which are connected to contact pins 5*a* and 5*b*.

The coil 1 is positioned underneath a nozzle 6 which communicates with a reservoir (not shown) containing magnetic powdery material 7. During the first phase (the filling phase), the coil is subjected to a vibratory motion (denoted by the double arrow 20) which has a dual effect: on the one hand, the density of the powdery material is increased, and on the other hand the surface thereof is smoothed so that the formation of an irregular surface is prevented. When the desired quantity of magnetic powder 7 is reached, the supply of further material is automatically interrupted by means of a device which will be described in detail hereinafter.

Figure 2:
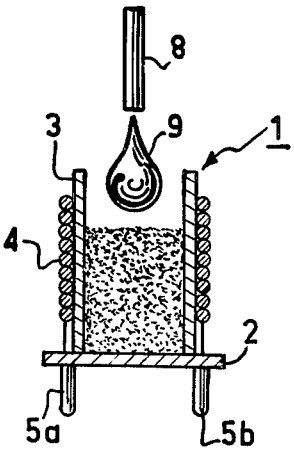
FIG. 2 is a longitudinal sectional view of the same coil during the formation of the cover plate.

When the filling phase illustrated in FIG. 1 has been completed, the coil 1 is displaced for the second phase and is arranged underneath another nozzle 8 (FIG. 2) which ejects a given quantity of a tough, liquid material 9 which is spread across the surface of the powdery magnetic material 7.

Figure 3:
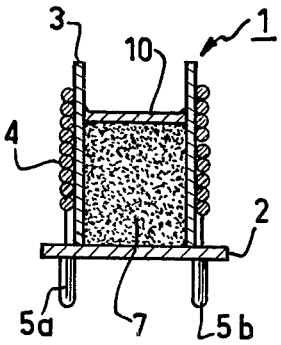
FIG. 3 is a longitudinal sectional view of the finished coil.

When the material 9 has spread across the surface of the magnetic material, and when it has been cured, a cover plate 10 (FIG. 3) is obtained which is bonded to the inner wall of the former 3 and which encloses the magnetic material 7.

For the tough, liquid material 9 use can be made of, for example, a product which sets by evaporation of a solvent, for example, a lacquer, or a thermosetting synthetic material or a synthetic latex which polymerizes in contact with air.

If the tough liquid material 9 is of a thermosetting type, the method may obviously comprises a third phase during which the temperature of the coil is raised to a suitable value for fast curing of the cover plate.

Figure 4:
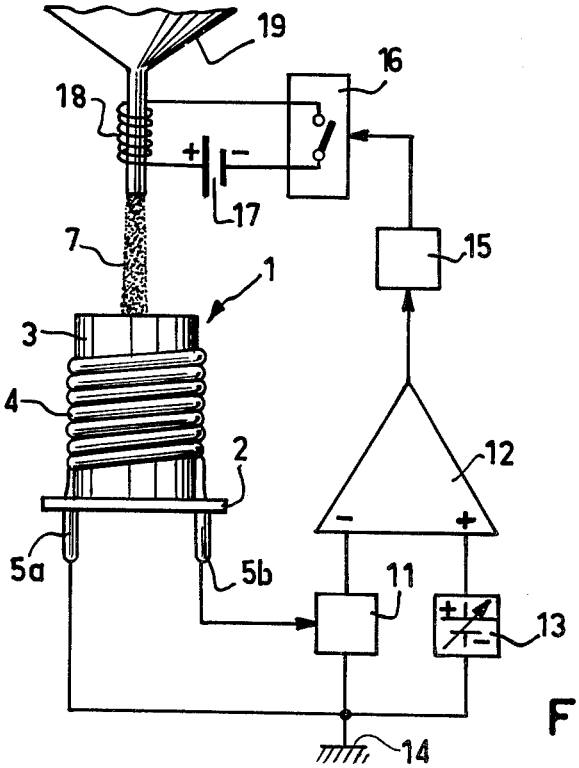
FIG. 4 shows a device for the automatic testing of the quantity of powdery magnetic material introduced during the filling phase.

In FIG. 4, which uses the same reference numerals as FIG. 1, the contact pin 5*b* of the coil 1 is connected to the input of an inductance measuring apparatus 11, the output of which is connected to one of the inputs of a comparison circuit 12, the second input of which is connected to a terminal of a variable direct voltage source 13. The terminal 5*a* of the coil 1, the other input of the measuring apparatus 11 and the other terminal of the source 13 are connected to a common ground terminal 14.

Via a control circuit 15, the output of the comparison circuit 12 is coupled to the control input of an electronic switch 16 which is connected in series with a voltage source 17 and with a coil 18 which envelops the nozzle 6 which is connected to a funnel 19 containing the powdery magnetic material 7.

The device shown in FIG. 4 for the automatic testing of the quantity of magnetic material operates as follows.

When the magnetic material 7 flows into the coil 1, the increasing inductance of this coil causes a direct voltage at the output of the measuring apparatus 11 which increases in the same proportion. When this voltage equals the reference voltage of the source 13, the state of the output of the comparison circuit 12 changes, so that the electronic switch 16 is closed via the control circuit 15, with the result that the coil 18 is energized. The magnetic field generated by the coil causes lumping of the magnetic material 7 in the nozzle 6 so that the supply from the funnel 19 is immediately interrupted.

The desired inductance can be chosen by variation of the reference voltage supplied by the source 13. Obviously, the nozzle 6 should be made of a non-magnetic material in order to prevent undesired clogging by remanent magnetism when the magnetic field produced by the coil 18 disappears.

What is claimed is:

1. A method of manufacturing a magnetic core for a coil which is wound on a cylindrical former rigidly connected to a base comprising contact pins, which method comprises, introducing a given quantity of a powdery soft-magnetic material into the coil former during a first phase, and depositing a given quantity of a tough, liquid material on the surface of the powdery material during a second phase to form a cover plate over the soft-magnetic material after curing.

2. A method as claimed in claim 1 comprising the further step of subjecting the coil to a vibratory motion during the first phase.

3. A method as claimed in claim 1, wherein tough, liquid material comprises a lacquer which sets by evaporation of a solvent.

4. A method as claimed in claim 1, wherein the tough, liquid material comprises a thermosetting synthetic material.

5. A method as claimed in claim 1, wherein the tough, liquid material comprises a synthetic latex which polymerizes in contact with air.

6. A method as claimed in claims 1 or 2 comprising the further step of measuring the inductance between the contact pins of the coil during said first phase, and automatically terminating the first phase when a predetermined inductance is measured.

* * * * *